United States Patent [19]

Jones et al.

[11] Patent Number: 4,637,732

[45] Date of Patent: Jan. 20, 1987

[54] HAND HELD ATHLETIC OFFICIATING TIMERS

[75] Inventors: Charles Jones, Rte. 3 Hwy. 29 S., Hope, Ark. 71801; James L. Murphy; Kenneth Burks, both of Little Rock, Ark.

[73] Assignee: Charles Jones, Hope, Ark.

[21] Appl. No.: 557,909

[22] Filed: Dec. 5, 1983

[51] Int. Cl.[4] ..... G04F 8/00

[52] U.S. Cl. ..... 368/109; 368/248

[58] Field of Search ..... 368/98, 230, 107–109, 368/243, 244, 248, 250, 261

[56] References Cited

U.S. PATENT DOCUMENTS

| | | | |
|---|---|---|---|
| 2,915,874 | 12/1959 | Ferguson, Jr. | 368/230 |
| 4,163,360 | 8/1979 | Tanaka et al. | 368/98 |
| 4,192,133 | 3/1980 | Komaki | 368/109 |
| 4,218,871 | 8/1980 | Moritani | 368/98 |
| 4,236,375 | 12/1980 | Komaki | 368/230 |
| 4,451,158 | 5/1984 | Selwyn et al. | 368/109 |
| 4,493,043 | 1/1985 | Forbath | 368/251 |
| 4,526,479 | 7/1985 | Harris | 368/284 |

FOREIGN PATENT DOCUMENTS

| | | | |
|---|---|---|---|
| 0134379 | 10/1980 | Japan | 368/230 |

*Primary Examiner*—Bernard Roskoski

*Attorney, Agent, or Firm*—Stephen D. Carver

[57] ABSTRACT

A sports timing device for referees, officials, umpires, coaches and the like. The timer is ideally adapted for football or basketball officiating and it contains circuit means for generating necessary timing signals for officiating the game. The circuit is initiated manually by depression of a primary switch, and timing alarm signals generated by the circuit actuate tactile stimulation means to vibrate the device enclosure to warn the referee or official without the necessity of him visually observing the apparatus. In the football mode the device preferably provides an alarm after expiration of twenty five seconds. In the basketball mode the device provides three second, five second and ten second warnings. Low battery signalling means are incorporated in the circuitry for immediately warning the user that the battery is weak prior to commencing a timing operation; also, an LED provides an immediate dead battery warning. The enclosure of the device is preferably symmetrically configured to readily adapt the timer for use by either the left or right hand, and preferably the timer is suspended from the wearer's wrist until the unit is actually needed. Alternatively the timer may be suspended from the user's waist.

3 Claims, 8 Drawing Figures

FIG. 3
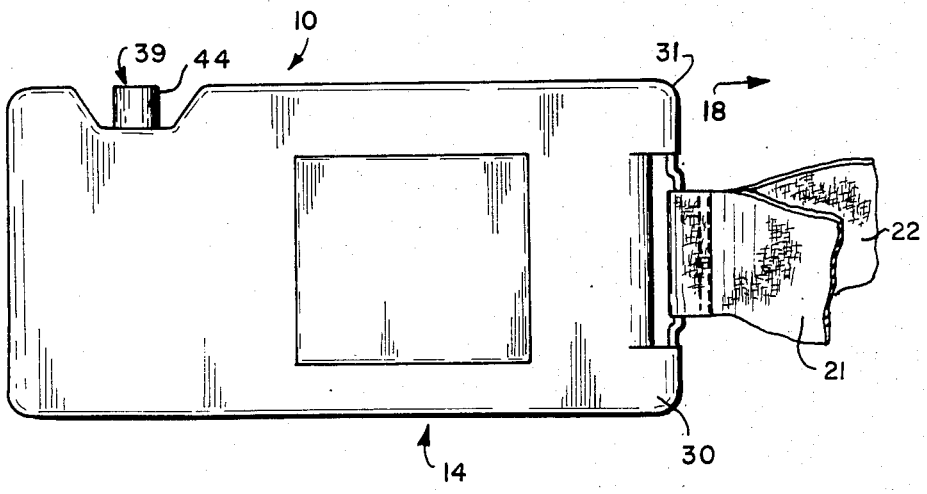
FIG. 4
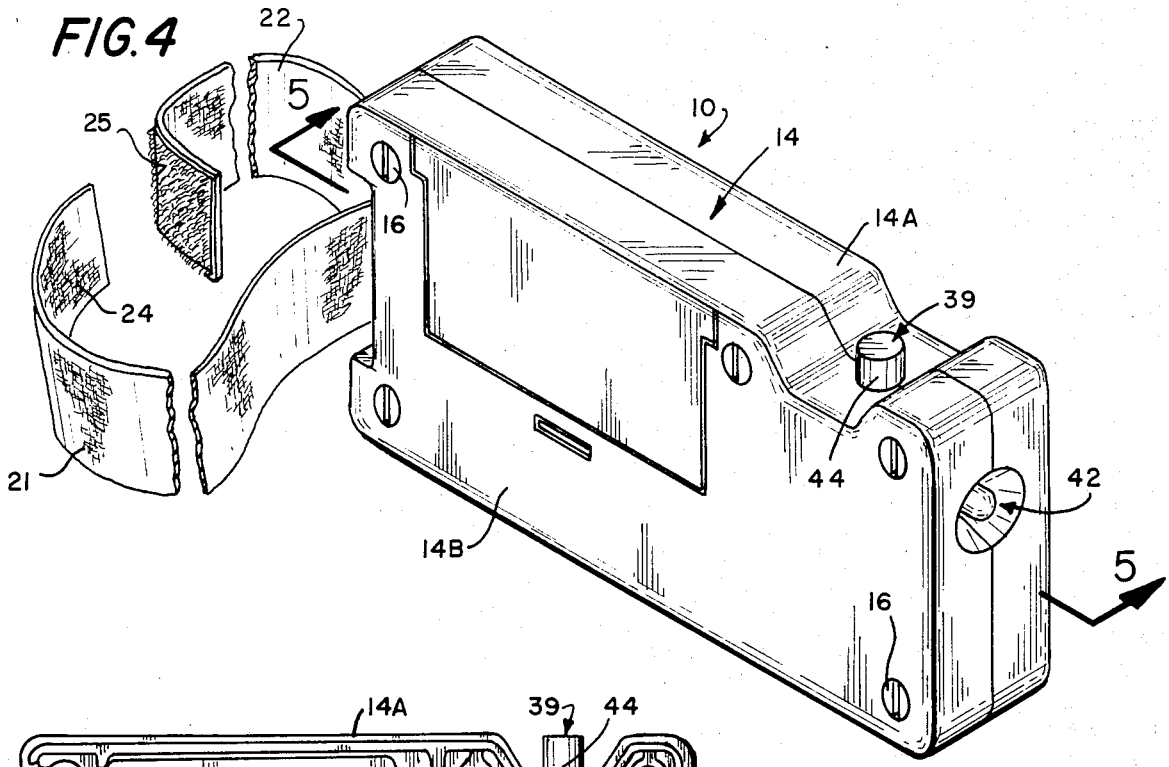
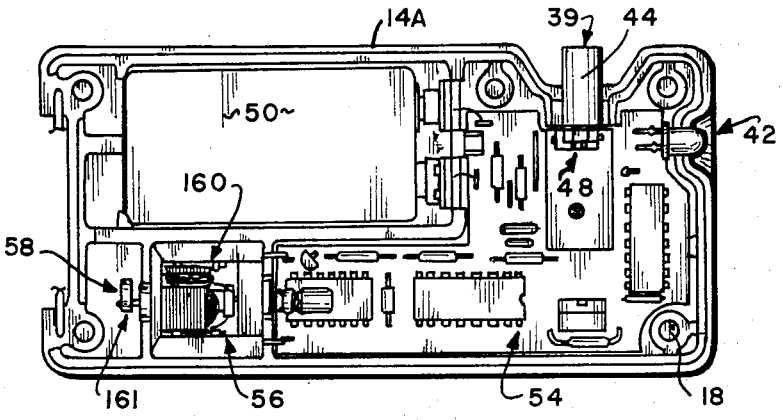
FIG. 5

HAND HELD ATHLETIC OFFICIATING TIMERS

BACKGROUND OF THE INVENTION

The present invention relates generally to electronic, digital timing apparatus. More particularly, the present invention is directed to a solid state timing and alarm device for use by football or basketball referees, officials, coaches, or the like.

As will readily be appreciated by even the most casual of sports fans, the rules of games such as basketball or football are literally replete with various timing requirements. In football, immediately after the ball has been placed for a down, the ball becomed "ready-for-play" and the referee is required to provide a "ready-for-play" signal. Immediately thereafter, in college or high school games, a twenty five second count begins in which time limit the ball must be snapped or free kicked.

Basketball has a variety of timing rules, involving time periods such as three, five and ten seconds. For example, a player must not remain for more than three seconds in that part of his or her free throw lane between the end boundary and the farther edge of the free throw line while the ball is in control of his or her team in his or her front court. A player has five seconds to commence "throw-in" during which time the ball must be directly thrown across the boundary line and must be touched by another player on the court before it goes out of bounds. It is also a violation for a player to dribble or combine dribbling and holding a ball in excess of five seconds while in his or her mid-court and not closely guarded. The five second time limit in basketball also applies to a wide variety of other situations. The basis purpose of the various five second time limits is to keep the ball in play and to avoid lack of action.

Various ten second time provisions also exist in basketball. For example, during the free throw, which is awarded to the offended team after a call of a personal foul, the try for goal must be made within ten seconds after the ball has been placed at the disposal of the free thrower at the free throw line. This rule applies to each free throw. Generally the ball must enter the basket or touch the ring within this ten second period.

In basketball the usual practice is for the referee to "count down" the aforementioned three, five or ten second periods. Usuallly the referee makes a swinging action with his hand, and relatively inaccurately attempts to count these time segments. Because of the very fast play involved in basketball, and the close judgmental nature of the various fouls, the referees and officials must concurrently keep accurate and continuous watch upon the ball and the players. This makes it extremely difficult to watch the various clocks, or sideline timing devices currently in use. This problem is further aggravated by the fact that the five second timing period, for example, may run out and immediately recommence. In actual practice it is not uncommon for the ten second call to be made by a referee after the expiration of absolute time periods of between seven to thirteen seconds. This well known and common timing inaccuracy reflects negatively upon the officials or referee and upon the game itself. Thus it is desirable to provide a system which will enable the referee to make extremely accurate timing calls, without the necessity for removing his eyes from the action.

The closest prior art known to us is U.S. Pat. No. 4,238,847 issued to Daily on Dec. 9, 1980. This device provides a digital countdown for electronically timing yacht races and is entirely dissimilar from the present invention. Other relevant previously issued U.S. patents include U.S. Pat. Nos. 3,643,255; 4,278,966; 3,253,275;4,312,056; 4,236,238; 4,280,063; and, 4,245,344. None of the prior art devices known to us provide tactile warnings to referees, officials, umpires, coaches or the like of the critical timing periods encountered in football, basketball, or other common sports.

SUMMARY OF THE INVENTION

The present invention comprises a self-contained, accurate electronic timing device for use by sports referees, officials, coaches or the like. The rigid enclosure is preferably symmetrically shaped, and may be selectively conveniently grasped by either hand of the referee, official or other user. The circuit disposed within the enclosure is actuated in response to depression of a switch mounted interiorly of the enclosure. After predetermined time has elapsed, the circuit generates an alarm signal which in turn actuates tactile stimulation means disposed within the enclosure thus generating a warning and alerting the user. Preferably the tactile simulator system includes a vibration system which will immediately be sensed by the hand of the user without the necessity of watching the timer. Therefore the user may properly officiate a game without taking his or her eyes off of the action.

In the football mode of the invention a twenty five second count is provided. In the basketball mode of the present invention, three, five, and ten second signals are generated. In both modes the circuit preferably comprises an oscillator and a triggered counter which are initially activated by primary switch means to produce three timing signals. Gate means are employed to generate a fourth signal for timing purposes in response to the three signals inputted to it, which fourth signal ultimately activates and logically controls the tactile stimulation means within the enclosure to provide a warning to the user. Low battery signalling means are incorporated in the circuit to instantly warn the user when the battery is weak or dead. In this manner the mistiming of a play is avoided, since the user will immediately be aware that a new battery must be installed. If a battery has not been installed, or if the battery is completely dead, an LED will cue the user of this problem.

Thus a primary object of the present invention is to provide an accurate timer for football or basketball referees, coaches, officials or the like.

A similar object is to provide an accurate timer of the character described, which will accurately provide officiating time signals, without requiring the user to visually observe the timer unit. In other words, it is an important feature of the present invention that it may be employed by referees or officials without distracting him or her from the play of the game.

A still further object of the present invention is to provide an athletic timer device of the character described which may be advantageously carried by either hand or either wrist of the user.

A related object is to provide a timer device of the character described which may be conveniently worn upon the belt or waist of the user.

A basic object of the present invention is to provide a dependable timer circuit which provides a tactile warning to the user.

A more specific object of the present invention is to warn a referee or official of certain timing periods by providing vibration which may be sensed by the body of the user.

A still further object of the present invention is to provide a timer device of the character described housed within an extremely light and portable hand-held enclosure.

Yet another object of the present invention is to provide a basketball timer along the lines discussed above which may be immediately reset by manual manipulations.

A still further object of the present invention is to provide an electronic, digitally controlled timer device of the character described which will immediately warn the referee, official or other user when its power source, nominally a battery, is low, weak, dead, inoperable, or missing.

A related object is to immediately warn the timer user upon activation of the main switch when the self contained power supply is inoperative.

Thus it is a related object of the present invention to prevent the miscall of a timing signal through the use of a timer having a dead battery.

These and other objects and advantages of the present invention, along with features of novelty appurtenant thereto, will appear or become apparent in the course of the following descriptive sections.

BRIEF DESCRIPTION OF THE DRAWINGS

In the following drawings, which form part of the specification and which are to be construed in conjunction therewith, and in which like reference numerals have been employed throughout whenever possible to indicate like parts in the various views:

FIG. 3 illustrates an enlarged, fragmentary side elevational view of the invention;

FIG. 4 is an enlarged, fragmentary isometric view thereof;

FIG. 5 is a reduced scale, side sectional view of the invention, taken generally along line 5—5 of FIG. 4 in the direction of the arrows;

DETAILED DESCRIPTION OF THE INVENTION

Figure 1:
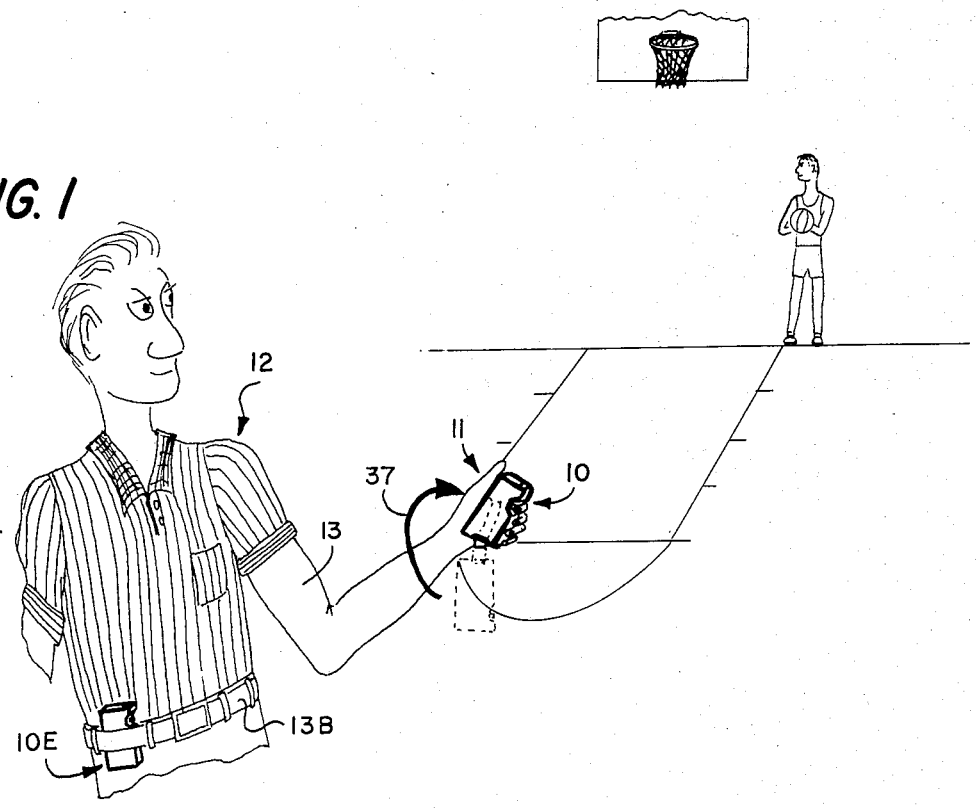
FIG. 1 is a fragmentary pictorial view illustrating use of the present invention by a referee or official.

With initial reference to FIG. 1 and 3 through 7, the timer 10 is of small, box-like dimensions and it is adapted to be easily manually held by the hand 11 of a referee or official 12. As will be appreciated from FIGS. 3 and 4, the timer 10 includes a case 14, which in turn comprises a pair of cooperating, members 14A and 14B which are adpated to be coupled together by a plurality of conventional screws 16 received, for example, within mating bosses 18 (FIG. 5) defined interiorly of housing section 14A. Alternatively, timer embodiment 10E may be clipped to the belt 13B of wearer 12.

Figure 6:
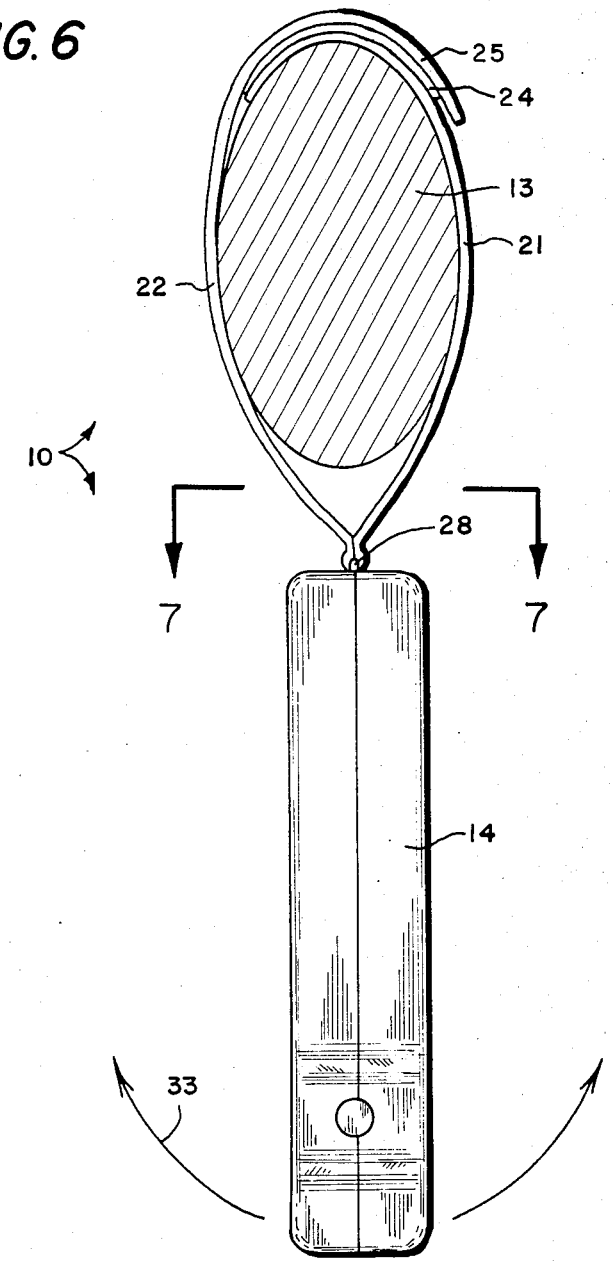
FIG. 6 is an enlarged sectional view of the invention in use.
Figure 7:
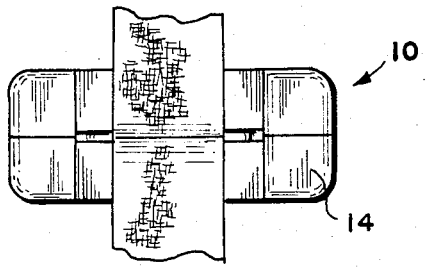
FIG. 7 is a bottom view thereof.

Although timer 10 is of generally rectangular side profile, it includes a front 18 to which a pair of Velcro-equipped straps 21 and 22 project. Straps 21 and 22 include Velcro fastener elements 24 and 25 which are adapted to be coupled together to semi-permanently suspend the timer 10 from the arm 13 or the wrist of the official 12. As best illustrated in FIG. 6, a rather tight fit may be provided about arm 13, and starps 21, 22 are coupled to enclosure 14 via a rigid hinge 28 received and anchored through butt ends 30, 31 of front 18 of the timer 10. As best illustrated by arrows 33 (FIG. 6), the latter construction enables the official 12 to run up and down the playing field or court with the device suspended from his hands, without interfering with his duties. However, when it is desired to employ the timer 10, it may be quickly "flipped" into his hand 11 in the manner illustrated by arrow 37 (FIG. 1).

Once the device, which is essentially symmetrical, is placed within the hand 11 of the user, the primary switch means 39 will be convenient to the operator. Because of the symmetry of device 10, it must be appreciated that switch means 39 will be equally convenient when the device 10 is held in either the left or right hand of the operator. Once the switch means 39 is activated, various timing signals will be generated in the manner hereinafter described, and basic timing programming will be perceived by the operator through tactile stimulation. In the preferred mode the entire timer 10 will be vibrated in order to warn the user.

Figure 2:
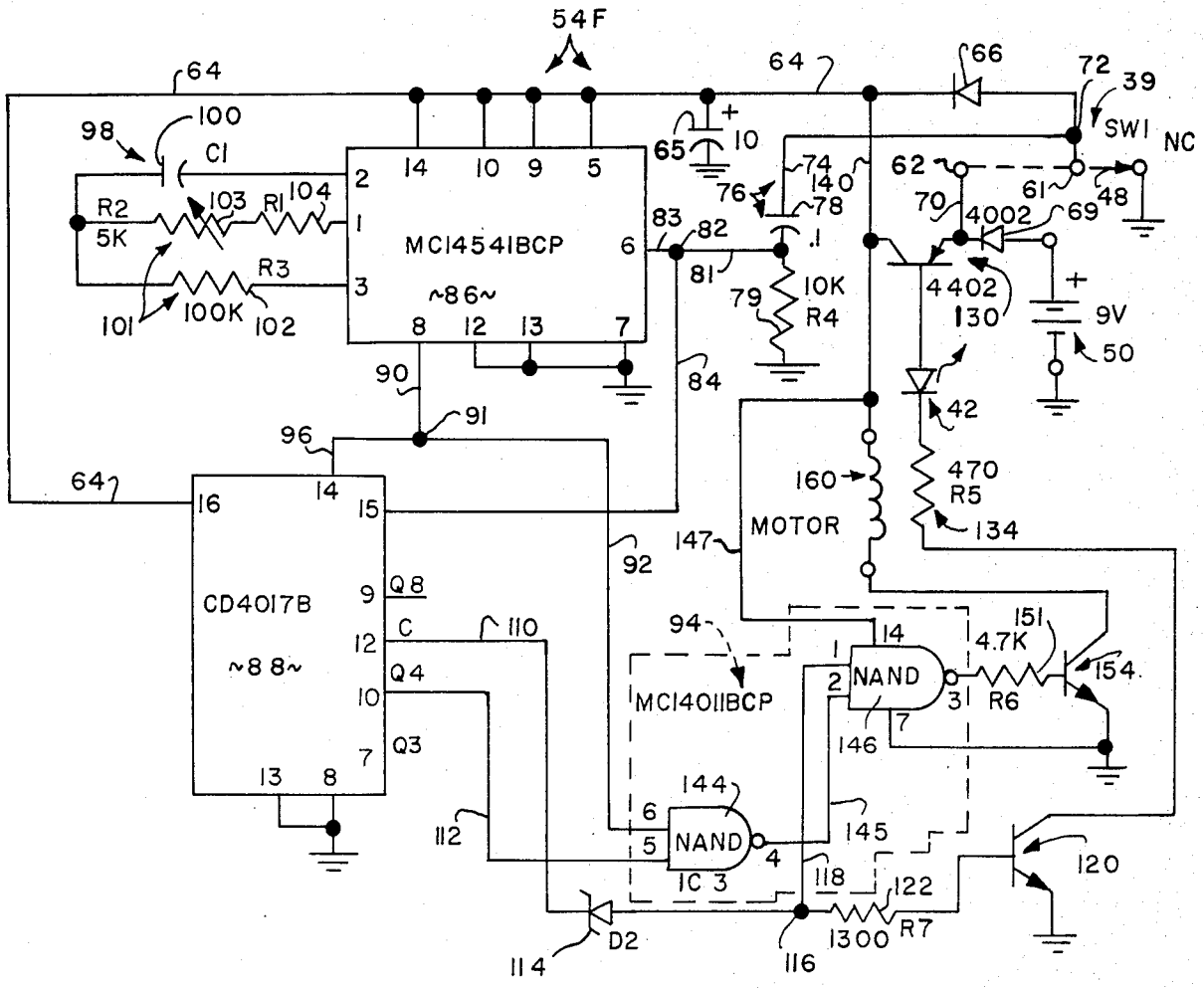
FIG. 2 illustrates the preferred mode of a football timer circuit constructed in accordance with the teachings of this invention.

Importantly, the primary signalling characteristic of the invention is to vibrate and thus provide tactile warning to the official or referee 12. The primary switch means 39 includes a conventional spring- biased push botton switch including a conventional button 44 which electrically closes contacts 48 to be later discussed in explanation of FIGS. 2 and 8. As best viewed in FIG. 5, power supplied through an internally captured, conventional battery 50 operates circuit 54 to ultimately provide timing signals by activating a motor 56 which provides vibration or tactile stimulation by rotating an eccentric 58. Circuit board 54 may be provided either with a basketball circuit, generally designated by the reference numeral 54B, (FIG. 8) or a football circuit generally designated by the reference 54F (FIG. 2). In either case it is fundamental to the invention that the user may perceive timing signals ultimately generated by initiation of the primary switch means 39, and he may do so while he is running up and down the playing field or court, without taking his eyes from the ball or action.

With reference now to FIG. 2, the football mode of the circuit 54F is initiated by manual depression of the primary switching means 39. As illustrated in FIG. 2, switch 39 is of a single pole, double throw (SPDT) variety, and is normally biased to the grounding position illustrated in FIG. 2. However, upon manual actuation, nodes 61 and 62 will temporarily be connected. When so actuated, Vcc is applied on line 64 through isolating diode 66. Bypass capacitor 65 is preferably connected between line 64 and chassis ground. Power is applied from battery 50 through diode 69 and line 79. Moreover, it will be apparent that node 72 becomems "hot" and initiation circuit 76 comprised of capactior 78 and resistor 70 will be activated through line 74. Circuit 76 essentially comprises a differentiator circuit which outputs a spike on line 81 upon actuation of the switch 39. This spike is transmitted to node 82, and from thence to an oscillator-divider micro-circuit 86 via line 83, and to a triggered counter circuit 88 via line 84.

Importantly, virtually instantaneously after activation of switch 39, light emitting diode 42 should come on to warn the user that a timing sequence has been initiated. If this diode does not visibly turn on, then the user must check the battery if reliable timing is to progress.

In the preferred mode the oscillator divider circuit 86 comprises a properly wired Motorola MC14541BCP integrated circuit. As illustrated, pin 6 thereof is connected to node 82 via line 83; pins 5, 9, 10 and 14 are connected to Vcc line 64 an pins 7, 12, and 13 are grounded. Pin 8 provides an output along a line 90 to a node 91. Node 91 interconnects with gate means generally designated by the reference numeral 94, via a line 92. Node 91 also is connected to circuit 88 via line 96. The time constant of circuit 86 is established by a companion outboard RC timing circuit 98. The time constant is established by the combination of capacitor 100 and the resistive leg generally designated by the reference numeral 101. The resistive leg includes fixed resistor 102, coupled in parallel with the series combination of variable resistor 103 and fixed resistor 104. Resistor 103, nominally 5000 ohms, is adjusted to provide an oscillator frequency of 1311 hz. in the football mode. The oscillator divider circuit 86 ,in the preferred mode, divides by the constant 8192. Hence in the football mode the square wave outputted to line 90 via pin 8 has a frequency of 0.1599 hz., and a resultant 6.250 second period. The latter signal thus actuates circuit 88 appearing at its count input on pin 14. The signal appearing at node 91 and the common lines 90, 96 and 92 comprises a first football timing signal.

The triggered counter circuit 88, nominally a Motorola CD4017B, generates a second football timing signal outputted on line 110 and a third football timing signal outputted on line 112. The second football timing signal is transmitted along line 110 through a voltage reference Zener diode 114 to node 116. Node 116 is in turn coupled to gate circuit 94 via line 118, and it is coupled to a latching transistor 120 via resistor 122. Pin 12 of circuit 88, which ouputs on line 110, goes high immediately upon receipt of the spike signal transmitted via line 84 to its pin 15. Hence transistor 120 is immediately turned on by switch 39 and therefore establishes a direct current signal path from battery 50 through diode 69, the emitter-base pathway through transistor 130, diode 42 and resistor 134. "Turn-on" of transistor 130 establishes a switch latching path through line 140 and the collector of transistor 130. Thus circuit 54F continues to operate after manual release of switch 39.

The gate circuit 94 includes a pair of interconnected NAND gates which generate a fourth timing signal in response to the first three signals delivered thereto. The first timing signal is delivered to NAND gate 144 via line 92, which couples to pin 6 of circuit 94. The second football timing signal appearing on line 110 is delivered to NAND gate 146 via line 118 which is coupled to pin 1 of circuit 94. The third football timing signal on line 112 is delivered to NAND gate 144, being coupled to pin 5 of circuit 94. The output of NAND gate 144 is delivered to the other input of NAND gate 146 (i.e. pins 4 and 2 of circuit 94 are jumpered together). Vcc is supplied to gate circuit 94 via line 147 which is connected to line 64 via line 140. The fourth football timing signal thus appearing at pin 3 of circuit 94 is transmitted through resistor 151 to actuate transistor 154, which in turn completes the signal path to the field winding of the internal motor 160 (i.e vibrator 56 in FIG. 5) thereby causing actuation of same. With reference to FIG. 5, it will be appreciated that initiation of motor 160 will cause rapid rotation of an eccentrically mounted weight 161 within enclosure 14 to thoroughly vibrate the timer 19 and hence provide tactile signals to the operator.

For the football circuit 54F the timing sequence is initiated by circuit 76 previously described. The first football timing signal on lines 90, 96 and 92 has a period of 6.25 seconds, meaning that the line is "high" for 3.125 seconds and then drops "low" for 3.125 seconds. Concurrently, the second football timing signal outputted from pin 12 of circuit 88 appears on line 110 and besides activating transistor 120, is transmitted to pin 1 of NAND gate 146. Line 110 goes high immediately upon initiation of circuit 88 via circuit 76 through lines 81, 84. The third football timing signal outputted from pin 10 of circuit 88 on line 112 goes high after four positive pulses on line 96. This third football timing signal is delivered to pin 5 of NAND gate 144. Twenty Five seconds after primary switch 39 is released, pin 4 on NAND gate 144 and pin 2 of NAND gate 146 go low. At this time pin 3 of NAND gate 146 goes high, turning on transistor 154 and energizing the vibrating motor, since its field 160 is activated. One half period later (3.125 seconds) the motor is turned off. By the design of circuit 88, the carry out output from pin 12 (line 110) remains high until the fifth count, at which time it drops low to unlatch transistor 120. Light emitting diode 42 is controlled by transistor 120 to provide an almost immediate visual warning of the initiation of a timing sequence.

Figure 8:
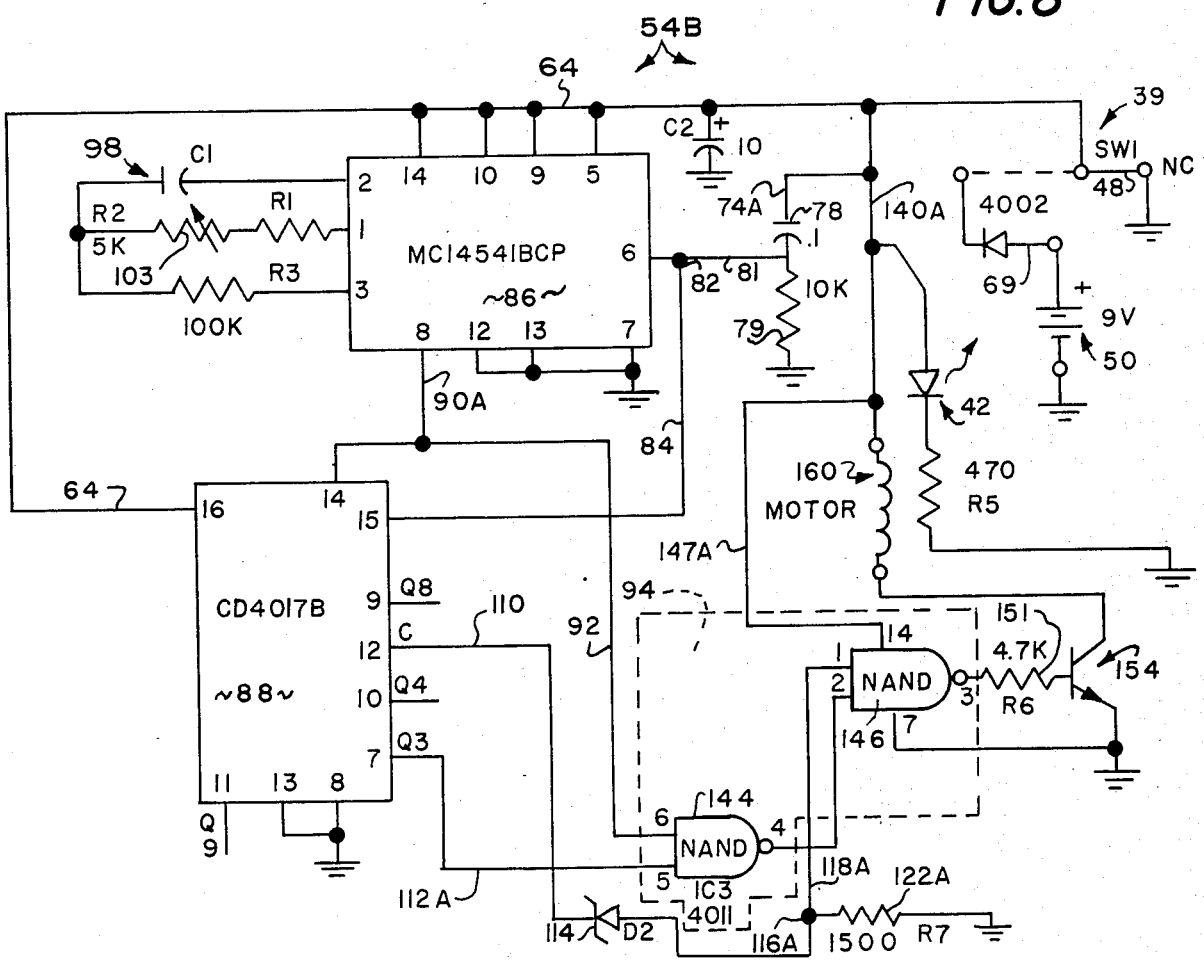
FIG. 8 is an electrical schematic diagram of the preferred mode for the basketball timer embodiment.

With reference now to FIG. 8 of the drawings, the basketball timing circuit 54B is quite similar to circuit 54F previously discussed. However, a comparison of FIGS. 2 and 8 will reveal that the basketball circuit lacks, for example, a latching transistor 130, an isolator diode 66 and a complimentary latching transistor 120. Circuit elements 86, 88, and 94 are the same.

Circuit 54B is activated by manual manipulation of switch 39 by depression of button 48. Since there is no electronic latching in circuit 54B (i.e. transistors 120, 130 are missing) this button must be held down for the circuit 54B to work properly. However, when the button is released, the circuit automatically resets for subsequent use. Because of the pace of basketabll, this automatic reset characteristic is desirable.

Again battery 50 supplies power through diode 69 and switch 39 to Vcc line 64, energizing microcircuit 86, 88. In this instance variable resistor 103 in timing circuit 98 is adjusted to provide an oscillation frequency of 8192 hz; circuit 86 divides by 8192, so a 1 hz square wave output appears on line 90A. This first basketball timing signal is applied to NAND gate 144 (i.e. it is coupled to pin 6 of gate circuit 94). A second basketball timing signal is outputted from microcircuit 88 on line 110, being transmitted through diode 114 and node 116A into NAND gate 146. However, a third basketball timing signal appearing on line 112A, outputted from pin 7 and circuit 88, goes high after three seconds for a one second duration. This signal is applied to NAND gate 144 (pin 5 of gate circuit 94). Circuit 88 functions as a positive edge triggered counter. Pin 5 of gate circuit 94 is high for one second; pin 6 is high for one half second; when pins 5 and 6 are high, pin 4 is low; when pin 6 goes low then pin 4 goes high, and pin 4 is normally high. After three seconds pin 4 goes from a high state to a low state, and this lasts for one half second.

Concurrently pin 1 of NAND gate 146 is high for five counts and is controlled by the second basketball signal on lines 110, 118A. Since NAND gate pins 1 and 2 are normally high, its output pin 3 is normally low. Pin 3 however goes high for one half second during turn on, after expiration of three seconds to provide a three second timing interval. Thus the fourth basketball timing signal is delivered through resistor 151 to turn on transistor 154 thereby energizing the field 160 of the vibrational motor. The five second timing function is logically controlled by pin 12 of circuit 88 which is high for five one second counts. On the fifth count five seconds have passed, so pin 12 goes low and thus pin one of NAND gate 146 goes low. Then since pin 12 is low for five seconds pin 3 will remain high for 5 seconds turning on the motor ,and this second turn-on indicates passage of five seconds, and the second turnn off indicates expiration of ten seconds. These three, five and ten second timing functions will occur constantly as long as the button portion of switch 39 is depressed.

Importantly, means are provided to immediately turn on the motor 160 when the battery 50 is low. This is exceedingly important since an official or referee will immediately discover that his battery is weak, without waiting for completion of a three, five or ten cycle count. Essentially toggle occurs in this circuit at one half Vcc. A logical high in this circuit comprises a voltage approximately one half of Vcc or greater; a logical low is somewhat less than one half Vcc. Therefore when battery 50 is unable to supply necessary current, and hence has a low voltage, pin 1 of NAND gate 146 will be low and, since this is a NAND gate, if either of its input pins are low the output will be high and thence the motor 160 will instantaneously vibrate. Therefore the referee will immediately be warned when the battery is low; if the battery is dead, or if a battery has not been installed at all, the LED will not light in the first place, and the prudent user will be warned.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A hand-held football timer for referees, officials, coaches, umpires or similar users, the timer comprising:

a rigid enclosure adapted to be selectively manually grasped or otherwise retained by said user, said enclosure being geometrically configured to readily facilitate ambidextrous usage by said user;

electronic circuit means disposed within said enclosure for generating an alarm signal when approximately twenty five seconds have elapsed after actuation of said circuit means; said circuit means comprising:

oscillator divider means for generating a first, football timing signal;

triggered counter means for generating second and third football timing signals in response to said oscillator divider means;

initiation means for initially activating said oscillator divider means and said triggered counter means in response to said primary switch means;

gate means responsive to said first, second and third football timing signals for generating a fourth football timing signal;

motor means for vibrating said enclosure; and, means responsive to said fourth football timing signal for logically controlling said tactile stimulation means;

tactile stimulation means disposed within said enclosure for generating a warning in response to said alarm signal, said tactile stimulation means comprising means for vibrating said enclosure and thus physically stimulating at least a portion of the body of said user to immediately warn said user notwithstanding where the user may be looking at the time;

user activated primary switch means for manually activating said circuit means, said circuit means including latching means for temporarily latching said primary switch means after initial activation of said primary switch means and means for unlatching said latching means after approximately twenty five second;

battery means disposed within said enclosure for powering said timer;

low battery signalling means for warning said user that said battery means is worn out immediately upon activation of said primary switch means; and, means for immediately providing a visual warning that said battery means is not dead in response to activation of said primary switch means.

2. A basketball timer for referees, officials, umpires, coaches or other users, the timer comprising:

a rigid enclosure adapted to be selectively manually grasped or otherwise retained by said user, said enclosure being geometrically configured to readily facilitate ambidextrous usage by said user;

circuit means disposed within said enclosure for generating an alarm signal to warn said user when time periods of three, five and ten seconds have expired after activation of said circuit means; said circuit means comprising:

oscillator divider means for generating a first basketball timing signal;

triggered counter means for generating second and third basketball timing signals in response to said oscillator divider means;

initiation means for initially activating said oscillator divider means and said triggered counter means in response to said primary switch means;

gate means responsive to said first, second and third basketball timing signals for generating a fourth basketball timing signal; and, means responsive to said fourth basketball timing signal for logically controlling said tactile stimulation means;

tactile stimulator means disposed within said enclosure for sequentially warning said user of the passage of said three, five and ten second time periods in response to said circuit means alarm signal;

selectively user activated primary switch means for manually activating said circuit means;

means for automatically resetting said circuit means upon release of said primary switch means by said user;

battery means disposed within said enclosure for powering said timer; and, low battery signalling means for warning said user that said battery means if worn out immediately upon activation of said primary switch means.

3. A basketball timer for referees, officials, umpires, coaches or other users, the timer comprising:

a rigid enclosure adapted to be selectively manually grasped or otherwise retained by said user, said enclosure being geometrically configured to readily facilitate ambidextrous usage by said user;

circuit means disposed within said enclosure for generating an alarm signal to warn said user when time periods of three, five and ten seconds have expired after activation of said circuit means; wherein said circuit means is adapted to, in operation:

first remains off for three seconds;

immediately after expiration of three seconds briefly warns said user so that the user is aware that three seconds have elapsed since said initial activation;

thereafter remains off until five seconds have elapsed since said initial activation; and then turn on for a period of only five seconds after expiration of five seconds from said initial activation, so that after finally turning off, ten seconds have elapsed and said user has been so warned notwithstanding where the user may have been looking at the time;

tactile stimulator means disposed within said enclosure for sequentially warning said user of the passage of said three, five and ten second time periods in response to said circuit means alarm signal;

selectively user activated primary switch means for manually activating said circuit means;

means for automatically resetting said circuit means upon release of said primary swtich means by said user;

battery means disposed within said enclosure for powering said timer; and, low battery signalling means for warning said user that said battery means is worn out immediately upon activation of said primary switch means.

* * * * *